US005110507A

United States Patent [19]

Ohtsuka et al.

[11] Patent Number: 5,110,507

[45] Date of Patent: May 5, 1992

[54] METHOD OF SEPARATING AND PURIFYING SPENT SOLVENT GENERATED IN NUCLEAR FUEL CYCLE

[75] Inventors: Katsuyuki Ohtsuka, Mito; Isao Kondo, Ibaraki; Takashi Okada, Katsuta, all of Japan

[73] Assignee: Doryokuro Kakunenryo Kaihatsu Jigyodan, Tokyo, Japan

[21] Appl. No.: 673,064

[22] Filed: Mar. 22, 1991

[30] Foreign Application Priority Data

Apr. 11, 1990 [JP] Japan ..... 2-95351

[51] Int. Cl.[5] ..... G21F 9/00

[52] U.S. Cl. ..... 252/626; 210/774; 210/806; 203/91; 203/48; 585/812; 562/608

[58] Field of Search ..... 252/626; 210/774, 806; 203/91, 48; 585/812; 562/608

[56] References Cited

U.S. PATENT DOCUMENTS 2,752,230 6/1956 Findlay ..... 585/812
2,813,099 11/1957 Weedman ..... 585/812
3,205,588 9/1965 Oetjen et al. ..... 252/631
3,361,649 1/1968 Karter ..... 203/12
4,981,616 1/1991 Ohtsuka et al. ..... 252/632

FOREIGN PATENT DOCUMENTS 635487 1/1962 United Kingdom ..... 585/812

*Primary Examiner*—Brooks H. Hunt
*Assistant Examiner*—Ngoclan T. Mai
*Attorney, Agent, or Firm*—Wenderoth, Lind & Ponack

[57] ABSTRACT

A method of separating and purifying a spent solvent generated in a nuclear fuel cycle and containing a phosphate and a higher hydrocarbon. This method comprises treating the spent solvent at a temperature not greater than the freezing point of the higher hydrocarbon but not less than the freezing point of the phosphate to selectively freeze the higher hydrocarbon, and separating a resulting frozen solid mainly composed of the higher hydrocarbon from a remaining solution containing the phosphate in a higher concentration. The remaining solution may further be subjected to low-temperature vacuum distillation to separate the solution into the phosphate and a deterioration product thereof.

4 Claims, 1 Drawing Sheet

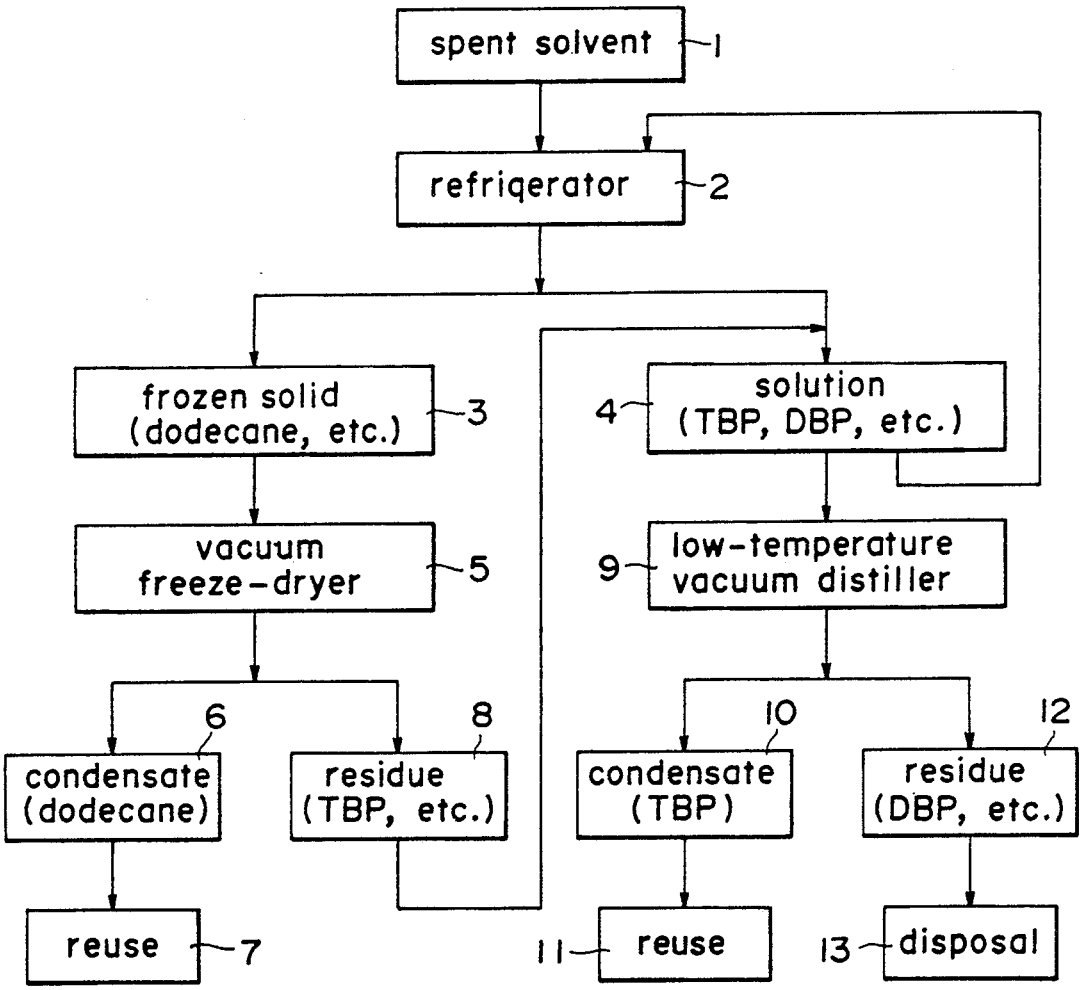
spent solvent
1
refrigerator
2
frozen solid (dodecane, etc.)
3
4
solution (TBP, DBP, etc.)
vacuum freeze-dryer
5
9
low-temperature vacuum distiller
6
8
10
12
condensate (dodecane)
residue (TBP, etc.)
condensate (TBP)
residue (DBP, etc.)
reuse
7
11
reuse
13
disposal

METHOD OF SEPARATING AND PURIFYING SPENT SOLVENT GENERATED IN NUCLEAR FUEL CYCLE

BACKGROUND OF THE INVENTION

The present invention relates to a method of separating and purifying a spent solvent discharged from a solvent extraction process in a nuclear fuel cycle, such as in a reprocessing plant for spent nuclear fuel or a nuclear fuel manufacturing plant.

The present invention can preferably be utilized in regeneration and disposal processes for such a spent solvent as described above.

A solvent prepared by diluting a phosphate, such as tributyl phosphate (TBP), with a higher hydrocarbon, such as n-dodecane (hereinafter referred to simply as "dodecane") and kerosene, is widely used in a solvent extraction step of a reprocessing process for spent nuclear fuel or of a wet scrap recovery process in a nuclear fuel manufacturing plant.

The spent solvent generated in the solvent extraction step contains deterioration products, such as dibutyl phosphate (DBP), formed as a result of degradation of a portion of TBP by an acid, heat, radioactive rays, etc. Such deterioration products adversely affect the extraction when the spent solvent is recycled for reuse. Therefore, the deterioration products are removed by alkali washing with an aqueous solution of sodium hydroxide or sodium carbonate. A radioactive waste containing the deterioration products thus removed, such as DBP, is converted into a vitrified solid or a bituminized solid by mixing the same with a vitrification additive or a bituminization additive. However, in order to stabilize a large amount of the sodium component incorporated by the alkali washing, it is necessary to use a large amount of these additives. Consequently, the development of a method of separating and purifying a spent solvent which enables deterioration products, such as DBP, to be removed without using sodium has been desired in the art.

On the other hand, methods such as vacuum freeze-drying and low-temperature vacuum distillation wherein the boiling point difference is utilized have been used as a method of separating TBP, DBP and dodecane from a spent solvent. However, they are disadvantageous in that the treatment capacity is small. Consequently, the development of a separation method having a large treatment capacity for a spent solvent has been desired in the art.

Moreover, when a spent solvent is heated to conduct distillation into components, there occur problems involving the danger of fire and also the danger that volatile nuclides undergo evaporation and sublimation upon heating, thus causing environmental contamination.

SUMMARY OF THE INVENTION

An object of the present invention is to provide a method of separating and purifying a spent solvent which has a large treatment capacity and enables deterioration products, such as DBP, to be efficiently removed by a further treatment without using reagents such as sodium.

Another object of the present invention is to provide a method of separating and purifying a spent solvent which enables the amount of generated radioactive waste to be reduced by virtue of possible recycling of the recovered solvent.

A further object of the present invention is to provide method of separating and purifying a spent solvent which is free from the danger of fire and environmental contamination.

In order to accomplish the above-described objects, according to the present invention, there is provided a method of separating and purifying a spent solvent generated in a nuclear fuel cycle and containing a phosphate and a higher hydrocarbon. This method comprises treating the spent solvent at a temperature not greater than the freezing point of the higher hydrocarbon but not less than the freezing point of the phosphate to selectively freeze the higher hydrocarbon, and separating a resulting frozen solid mainly composed of the higher hydrocarbon from a remaining solution containing the phosphate in a higher concentration.

Since the freezing point of dodecane, for example, is −9.6° C. and the freezing point of TBP is not greater than −80° C., the freezing treatment of a spent solvent containing them at a temperature of not greater than −9.6° C. but not less than −80° C. results, due to the freezing point difference therebetween, in the separation into a frozen solid mainly composed of dodecane and a solution containing unfrozen TBP n a concentrated form. Deterioration products, such as DBP, contained in the spent solvent, remain in the solution without causing freezing.

Thus, the spent solvent comprising a mixture of dodecane with TBP, DBP, etc., can be separated and concentrated by the freezing treatment into a fraction containing highly concentrated dodecane and a fraction containing highly concentrated TBP and DBP.

The resulting fraction containing highly concentrated BP and DBP may further be subjected to low-temperature vacuum distillation to recover TBP and remove DBP as a residue. On the other hand, the resulting fraction containing highly concentrated dodecane may further be subjected to vacuum freeze-drying to recover dodecane.

BRIEF DESCRIPTION OF THE DRAWING

The attached drawing is a flow sheet illustrating a preferred embodiment of the invention.

PREFERRED EMBODIMENTS OF THE INVENTION

The present invention will now be described in more detail with reference to a preferred embodiment illustrated in the attached drawing. A spent solvent 1 containing dodecane, TBP and the deterioration products of TBP (DBP, etc.) is chilled by means of a refrigerator 2 to be separated into a frozen solid 3 mainly composed of dodecane and a solution 4 mainly composed of TBP and DBP.

One example of the freezing separation treatment will now be described. A solvent containing dodecane and TBP in concentrations of 70% and 30% respectively was put in a cylindrical container, and the side of the container was chilled from its outside to keep the solvent at −20° C. for a period of 4 hours. As a result, a doughnut-shaped frozen solid mainly composed of dodecane was formed, and a solution having TBP concentrated to a concentration of 80% remained in the middle part of the container. Dodecane could be separated from TBP by separating the resulting frozen solid from the remaining solution. Such a solid-liquid separation may be carried out, for example, by removing the solution from the frozen solid or by filtration using a filter.

In conducting this freezing separation treatment, the separation efficiency of dodecane from TBP and DBP can be improved by adding a substance having a freezing point below that of dodecane and capable of dissolving TBP and DBP, such as an alcohol, to the untreated spent solvent prior to the freezing treatment.

In the embodiment shown in the flow sheet, the frozen solid 3 comprising dodecane and the solution 4 containing TBP and DBP roughly separated by the above-described freezing treatment are further separately purified so as to allow dodecane and TBP to be recycled. That is, the frozen solid 3 comprising dodecane is treated by a vacuum freeze-dryer 5 to be separated into a dodecane condensate 6 and a residue 8. The vacuum freeze-drying may be carried out, for example, by cooling the frozen solid 3 to about −40° C. and then increasing the temperature up to about +20° C. under a degree of vacuum of about 0.05 Torr. The dodecane condensate 6 is recovered and reused 7 according to necessity. The residue 8 is mixed with the solution 4 because it contains TBP, etc. On the other hand, the solution 4 is treated by means of a low-temperature vacuum distiller 9 to be separated into a TBP condensate 10 and a residue 12 comprising DBP, etc. The low-temperature vacuum distillation may be carried out, for example, by cooling the solution 4 to about −30° C. and then increasing the temperature up to about +40° C. under a degree of vacuum of about 0.015 Torr. The TBP condensate 10 is recovered, purified and reused 11 according to necessity. If necessary, the residue 12 is subjected to recovery of nuclear materials and then to disposal treatment 13.

TBP may further be concentrated by returning the solution 4 containing the TBP and DBP to the refrigerator 2 and repeating the freezing treatment.

As is apparent from the foregoing, according to the present invention, a spent solvent can efficiently be separated by freezing treatment into a higher hydrocarbon, such as dodecane, and a phosphate, such as TBP and DBP. Further, the operation is performed at low temperatures, so that it is free from the danger of fire, thereby enhancing its safety.

In addition, the amount of a spent solvent to be treated can be increased to a great extent as compared with the amount thereof to be treated by a conventional method in which the spent solvent is directly treated by vacuum freeze-drying or low-temperature vacuum distillation. Further, regarding the TBP and DBP contained in the solution obtained by the freezing treatment, DBP can be removed from TBP by low- temperature vacuum distillation, etc., without the necessity for conducting washing with sodium. As a result, there is no generation of a waste containing sodium, so that it is not necessary to conduct vitrification or bituminization.

Still further, recovered dodecane and TBP can be recycled, so that the amount of generated radioactive waste can be reduced.

Although the present invention has been described with reference to the preferred embodiments thereof, many modifications and alterations may be made within the scope of the appended claims.

What is claimed is:

1. A method of separating and purifying a spent solvent generated in a nuclear fuel cycle and containing a phosphate and a hydrocarbon selected from the group consisting of n-dodecane and kerosene, said method comprising exposing the spent solvent to a temperature not greater than the freezing point of the hydrocarbon but not less than the freezing point of the phosphate to selectively freeze the hydrocarbon, separating a resulting frozen solid mainly composed of the hydrocarbon from a remaining solution containing the phosphate in a higher concentration, and subjecting the resulting frozen solid to vacuum freeze-drying to thereby recover the hydrocarbon.

2. The method according to claim 1, wherein the phosphate is tributyl phosphate and the hydrocarbon is n-dodecane.

3. The method according to claim 1, which further comprises mixing the remaining solution with an additional spent solvent and subjecting the mixture to the freezing treatment.

4. The method according to claim 1, which further comprises subjecting the remaining solution to low-temperature vacuum distillation to thereby separate the solution into the phosphate and a deterioration product thereof contained in the solution, said deterioration product being formed as a result of degradation of a portion of the phosphate.

* * * * *